US007887985B2

(12) United States Patent
Nishikawa

(10) Patent No.: US 7,887,985 B2
(45) Date of Patent: Feb. 15, 2011

(54) CARRIER AND TWO-COMPONENT DEVELOPER

(75) Inventor: Toru Nishikawa, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 518 days.

(21) Appl. No.: 12/005,278

(22) Filed: Dec. 27, 2007

(65) Prior Publication Data

US 2008/0160440 A1 Jul. 3, 2008

(30) Foreign Application Priority Data

Dec. 28, 2006 (JP) ..... P2006-356276

(51) Int. Cl.
*G03G 9/00* (2006.01)

(52) U.S. Cl. ..... 430/111.1; 430/108.6

(58) Field of Classification Search ..... 430/108.6, 430/111.1

See application file for complete search history.

(56) References Cited

U.S. PATENT DOCUMENTS 6,746,810 B2 * 6/2004 Suzuki et al. ..... 430/119.86
2005/0277049 A1 * 12/2005 Katoh et al. ..... 430/111.35
2006/0008723 A1 * 1/2006 Fujikawa et al. ..... 430/108.6

FOREIGN PATENT DOCUMENTS

| | | |
|---|---|---|
| JP | 4-177369 | 6/1992 |
| JP | 11-194544 | 7/1999 |
| JP | 2003-255591 | 9/2003 |
| JP | 2005-345999 | 12/2005 |

* cited by examiner

*Primary Examiner*—Mark A Chapman
(74) *Attorney, Agent, or Firm*—Nixon & Vanderhye P.C.

(57) ABSTRACT

A carrier and a two-component developer are provided. A coating resin layer for coating a core material contains fine particles of titanium oxide which comprise an anatase-type crystal and a rutile-type crystal, and a carrier coating amount of the coating resin layer falls in a range of from 5% by weight to 20% by weight. In addition, a content rate of the rutile-type crystal falls in a range of from 5% to 20% on the basis of the total amount of crystal, and the weight of the fine particles of titanium oxide falls in a range of from 5% by weight to 50% by weight relative to the weight of the core material. Further, the primary particle size of the fine particles of titanium oxide falls in a range of from 40 nm to 80 nm.

4 Claims, No Drawings

CARRIER AND TWO-COMPONENT DEVELOPER

CROSS-REFERENCE TO RELATED APPLICATION

This application claims priority to Japanese Patent Application No. 2006-356276, which was filed on Dec. 28, 2006, the contents of which are incorporated herein by reference in its entirety.

BACKGROUND OF THE INVENTION

1. Field of the Invention

The present invention relates to a carrier for a developer, and a two-component developer containing the same and a toner.

2. Description of the Related Art

An electrophotographic system to which a Carlson process is applied has been widely used in an image forming method using a developer. In an image forming apparatus using the electrophotographic system, an image is formed by performing a charging step, an exposing step, a developing step, a transferring step, a cleaning step, a fixing step, and so forth. In the charging step, a surface of a photoreceptor is uniformly charged in darkness. In the exposing step, an original image is projected onto the charged photoreceptor, resulting in that charges on the surface of the charged photoreceptor exposed to light are removed and an electrostatic latent image is formed thereon correspondingly. In the developing step, a visible image is formed by adhering a toner of a developer onto the electrostatic latent image which is formed on the surface of the photoreceptor. In the transferring step, the toner image is transferred onto a recording medium such as a piece of paper and a sheet by allowing the recording medium to be in contact with the visible image formed on the surface of the photoreceptor and then by performing corona discharge from a side opposite to a contact side of the recording medium with the visible image so as to charge the recording medium with a polarity opposite to that of the toner. In the fixing step, the visible image transferred onto the recording medium is fixed by means of, for example, heating and pressurizing. In the cleaning step, the residual toner remaining on the surface of the photoreceptor without having been transferred onto the recording medium is recovered. By repeating the steps mentioned above, the image forming apparatus using an electrophotographic process forms a desired image on the recording medium.

It has heretofore been known that the developer employed in the image forming apparatus using the electrophotographic system contains the toner produced by a pulverization method, a polymerization method or the like method. The pulverization method is a method in which a thermoplastic resin, a coloring agent, a charge control agent, a wax as an anti-offset agent, and the like agent are melt-kneaded followed by being cooled to be solidified, to thereby prepare a melt-kneaded product, and then the melt-kneaded product thus-prepared is pulverized and classified, to thereby produce the toner. Particularly, in a full color printing, many techniques for making a wax as an anti-offset blend into a toner have been disclosed. Further, the toner can be produced by the polymerization method, for example, a suspension polymerization method or an emulsion polymerization method.

Presently, an image forming apparatus such as a copying machine and a printer, has been downsized and has been made capable of performing high-speed operations. Consequently, in order to obtain a high-quality image for a long period of time, it is required to develop a developer excellent in durability and environmental stability.

In the case of a two-component developer composed of a toner and a carrier, in order for a developer excellent in durability and environmental stability, research and development of carriers such as optimization of core material type, coating resin type and coating resin amount is important for the purpose to stably charge a developer inside an image forming apparatus as well as research and development of toners.

In addition, carriers which have such property as powder characteristics, electrical characteristics, and magnetic characteristics, are required to exhibit developing system-tailored performance. In recent years, in order to improve triboelectric charging property, durability, and environmental stability, a carrier in which a core material is coated with a coating resin layer has come into wider use. By using a carrier in which a core material is coated with a predetermined resin, it is possible to prevent the carrier surface from contamination such as the formation of toner film or the like, thus enabling the achievement of a developer excellent in durability and environmental stability.

Typical related art for developing the carrier mentioned above include, for example, the art disclosed in Japanese Unexamined Patent Publication JP-A 4-177369 (1992). In the color developer described therein, by adding externally titanium oxide or alumina into toner particles, fluidity is imparted to the color developer without deterioration in charging stability. Moreover, durability and environmental stability of the two-component developer are improved by setting the weight of a coating resin (a coating resin layer) to fall in a range of from 0.1% by weight to 5.0% by weight relative to the weight of a carrier core material (a core material), wherein the coating resin contains a nitrogen-containing component for stabilizing chargeability.

Further, in the electrophotographic two-component developer described in Japanese Unexamined Patent Publication JP-A 2003-255591, the coating material resistance to peel-off from the carrier core material is improved by setting the weight of a coating material (a coating resin layer) to be greater than 5.0% by weight relative to the weight of the carrier core material. In addition, environmental property of the two-component developer is improved by adding conductive fine powder such as magnetite ($FeO.Fe_2O_3$) to the toner.

Further, it is necessary that the developer has appropriate fluidity and chargeability such that the toner of the developer can be smoothly adhered to an electrostatic latent image formed on a surface of a photoreceptor. The fluidity and the chargeability of the developer vary in accordance with compositions of carrier.

In recent years, the image forming apparatus has been downsized and has been made capable of performing high-speed operations. This leads to that, in forming an image by using the image forming apparatus described above, stress to be given to the developer comes to be larger than that in the conventional image forming apparatus.

In the case of the long-time use of the color developer described in JP-A 4-177369 using the carrier in which the weight of the coating resin falls in a range of from 0.1% by weight to 5.0% by weight relative to the weight of the carrier core material, the coating resin peels off from the carrier core material, thereby causing the surface of the carrier core material to be exposed undesirably. That is to say, in the case of image forming using the downsized image forming apparatus capable of performing high-speed operations, the color developer described in JP-A 4-177369 has insufficient durability incapable of maintaining the carrier characteristics of an initial stage. This undesirably leads to problems with the thus-obtained image, such as a decline in image density.

Meanwhile, in the electrophotographic two-component developer disclosed in JP-A 2003-255591, the weight of the coating material exceeds 5.0% by weight relative to the weight of the carrier core material, resulting in that the surface of the carrier core material is less easily to be exposed even after a long-time use in the downsized image forming apparatus capable of performing high-speed operations. This shows that the developer disclosed in JP-A 2003-255591 is a developer excellent in durability capable of maintaining the carrier characteristics for a long period of time. However, depending on types of coating materials, the coating of the carrier core material with an excessively large amount of the coating material may induce a failure to secure the environmental stability. For this reason, a toner concentration in the developer is unstable in a high-temperature and high-humidity environment, thereby possibly inducing toner scattering, background fogging, or the like. In the art described in JP-A 2003-255591, the problem of deteriorating environmental stability mentioned above is solved by adding externally magnetite to the toner.

In addition, in the case of making a wax as an anti-offset agent blend into a toner, the increase in a blending amount of the wax leads to toner-induced contamination of carrier and deterioration in fluidity of a developer using the toner, thus causing a decline in chargeability, an unevenness of a solid image, or the like problem. This is because the increase in the blending amount of the wax results in difficulty in the dispersion of a part of wax into the toner, even when a kneading operation is applied thereto.

The inventors of the invention have verified that the regulation of compositions and concentration of a toner in which an external additive has been added, enables the achievement of a two-component developer which is excellent in durability and environmental stability even when the weight of a carrier coating resin is 5.0% by weight or more relative to the weight of a core material, and further which is excellent in carrier resistance to toner contamination and makes a developer using the carrier exhibit excellent fluidity, even when the blending amount of wax in the toner is high.

SUMMARY OF THE INVENTION

An object of the invention is to provide a carrier for a developer and a two-component developer excellent in durability and environmental stability, by changing the composition of the carrier. Further, another objection of the invention is to provide a carrier for a developer and a two-component developer excellent in resistance to toner contamination and in fluidity.

The invention provides a carrier constituting a two-component developer, comprising a core material; and a coating resin layer with which the core material is coated, the coating resin layer being in an amount of from 5% by weight to 20% by weight relative to a weight of the core material, and the coating resin layer containing fine particles of titanium oxide having an anatase-type crystal structure and a rutile-type crystal structure.

According to the invention, in a carrier constituting a two-component developer, a coating resin layer with which a core material is coated is in an amount of from 5% by weight to 20% by weight relative to the weight of the core material. This enables the achievement of the carrier excellent in durability in which the carrier core material is less easily to be exposed even after having been used for a long period of time in a downsized image forming apparatus capable of performing high-speed operations.

Further, the coating resin layer contains the fine particles of titanium oxide having an anatase-type crystal structure and a rutile-type crystal structure. This enables chargeability in a high-temperature and high-humidity environment to be improved and stabilized, even when the coating resin layer is in an amount of 5% by weight or more relative to the weight of the core material. Therefore, a carrier excellent in environmental stability can be obtained.

Further, in the invention, it is preferable that a content rate of the rutile-type crystal falls in a range of from 5% to 20% on the basis of the total amount of crystal.

According to the invention, a content rate of the rutile-type crystal falls in a range of from 5% to 20% on the basis of the total amount of crystal. This enables the achievement of a carrier exhibiting more excellent environmental stability, even when the coating resin layer is in an amount of 5% by weight or more relative to the weight of the core material. Moreover, it is possible to obtain a carrier which exhibits excellent resistance to toner contamination and makes a developer using the carrier exhibit excellent fluidity, even when being combined with a toner having a high blending amount of wax.

Further, in the invention, it is preferable that the fine particles of titanium oxide are contained in an amount of from 5% by weight to 50% by weight relative to the weight of the core material.

According to the invention, the fine particles of titanium oxide are contained in an amount of from 5% by weight to 50% by weight relative to the weight of the core material. This enables the chargeability in high-temperature and high-humidity environment can be further improved and stabilized, thus making it possible to obtain a carrier exhibiting more excellent environmental stability.

Further, the invention, it is preferable that a primary particle size of the fine particles of titanium oxide falls in a range of from 40 nm to 80 nm.

According to the invention, a primary particle size of the fine particles of titanium oxide falls in a range of from 40 nm to 80 nm. This makes it possible to obtain a carrier which exhibits excellent resistance to toner contamination and makes a developer using the carrier exhibit excellent fluidity, even when being combined with a toner having a high blending amount of wax.

Further, the invention provides a two-component developer comprising a toner and the carrier mentioned above.

According to the invention, a two-component developer comprises a toner and the carrier mentioned above which is excellent in durability and environmental stability, so that it is possible to obtain a two-component developer which can exhibit a stable chargeability even after having been used for a long period of time in a high-temperature and high-humidity environment in a downsized image forming apparatus capable of performing high-speed operations. Therefore, it is possible to obtain a two-component developer capable of realizing a high-quality image.

DETAILED DESCRIPTION

Now referring to the drawings, preferred embodiment of the invention are described below.

The invention relates to a carrier and a two-component developer composed of the carrier and a toner. In the carrier, a core material is coated with a coating resin layer which contains fine particles of titanium oxide having an anatase-type crystal structure and a rutile-type crystal structure and which is in an amount of from 5% by weight to 20% by weight relative to the weight of the core material.

[Carrier]

The carrier in the invention is constituted by coating a core material with a coating resin layer which contains coating resin, fine particles of titanium oxide, carbon black, and the like.

The carrier can be manufactured by using conventionally known methods. For example, the carrier in which a core material is coated with a coating resin can be manufactured by the following process: dispersing each constituent of the coating resin layer such as the coating resin, the fine particles of titanium oxide, and carbon black into a toluene solvent or the like solvent; applying the resultant dispersed fluid to the core material according to a spraying method, a dipping method, or the like; and then curing the applied coating resin by application of heat.

The weight of the coating resin layer is preferably in a range of from 5% by weight to 20% by weight relative to the weight of the core material. In this way, a carrier excellent in durability can be obtained, in which the carrier core material is less easily exposed even after having been used for a long period of time in a downsized image forming apparatus capable of performing high-speed operations. When the weight of the coating resin layer is less than 5% by weight on the basis of the core material, abrasion and peel-off resulted from the friction in a developing tank tend to be generated, thereby shortening the service life of the carrier undesirably. When the weight of the coating resin layer is greater than 20% by weight, the core material is coated with a large amount of coating resin layer, thereby deteriorating environmental stability of the carrier undesirably.

Next, descriptions will be given to the constituents of the carrier in the invention.

(Coating Resin)

The coating resin layer is constituted by containing the coating resin. No particular limitation is imposed on the selection of the coating resin and a publicly known resin can be used. Examples of the coating resin include a polyester type resin, a fluorine type resin, an acrylic resin, and a silicone type resin. Further, the additive amount of the coating resin preferably falls in a range of from 2% by weight to 18% by weight relative to the weight of the core material.

(Fine Particles of Titanium Oxide)

The coating resin layer is constituted by containing the fine particles of titanium oxide having an anatase-type crystal structure and a rutile-type crystal structure. That is, the two types of crystals are present in a mixed state in the titanium oxide fine particles. In this way, even when the weight of the coating resin layer is 5% by weight or more relative to the weight of the core material, the chargeability in a high-temperature and high-humidity environment can be improved and stabilized, thereby enabling a carrier excellent in environmental stability to be obtained. In a case where a content rate of the rutile-type crystal is 0% in the fine particles of titanium oxide, that is, the fine particles of titanium oxide are only composed of the anatase-type crystal, coagulation occurs between the fine particles of titanium oxide, thus leading to deterioration in the dispersion of the titanium oxide fine particles into the coating resin layer of the carrier. This causes deterioration in environmental stability, resistance to toner contamination, and fluidity of the carrier.

The content rate of the rutile-type crystal preferably falls in a range of from 5% to 20% on the basis of the total amount of crystal. In this way, even when the weight of the coating resin layer is 5% by weight or more relative to the weight of the core material, it is possible to obtain a carrier which exhibits more excellent environmental stability. Moreover, it is possible to obtain a carrier which exhibits excellent resistance to toner contamination and makes a developer using the carrier exhibit excellent fluidity, even when being combined with a toner having a high blending quantity of wax.

The rutile-type crystal has an excellent polishing effect due to that the rutile-type crystal is higher in hardness than the anatase-type crystal or an amorphous substance. This thereby makes it possible to scrape off the toner adhered to the carrier, resulting in that the carrier exhibits excellent resistance to the toner contamination. When the content rate of the rutile-type crystal is less than 5%, the toner adhered to the carrier fails to be scraped off from the carrier, thus deteriorating the carrier resistance to toner contamination.

In addition, the anatase-type crystal is generally a needle-like or rod-like particle. However, in the invention, a discotic anatase-type crystal is employed without being sintered to be a needle-like particle, thereby contributing more to the improvement in the fluidity. On the other hand, the rutile-type crystal is formed to be a needle-like or columnar shape by means of crystal growth, thus contributing little to the improvement in the fluidity. For this reason, when the content rate of the rutile-type crystal is greater than 20%, the fluidity is deteriorated.

The surfaces of the titanium oxide fine particles are preferably subjected to a hydrophobic treatment. Examples of the hydrophobic treatment include a treatment by a silane coupling agent such as dimethyl dichlorosilane or an amylosilane, a treatment by a silicone oil, and a treatment by a fluorine-containing component or the like component.

The fine particles of titanium oxide are preferably in an amount of from 5% by weight to 50% by weight relative to the weight of the core material. In this way, chargeability in a high-temperature and high-humidity environment can be further improved and stabilized, thereby enabling the achievement of a carrier exhibiting more excellent environmental stability. In order for excellent environmental stability, the electrification amount of toner is preferably increased as high as possible. However, in the related art for producing a carrier, a sufficient image density is hardly obtained in the case of a high electrification amount of toner. Accordingly, it is difficult to secure a high electrification amount of toner and a high development property simultaneously. To solve this problem, as has mentioned above, by making the high-permittivity titanium oxide fine particles be contained in the coating resin layer, the permittivity of the developer is increased and the electrolysis intensity between a developing sleeve and a photoreceptor is improved, thus enabling the high development property and the high electrification amount of toner to be secured simultaneously. When the content of the fine particles of titanium oxide is less than 5% by weight, the fine particles of titanium oxide contribute little to the improvement in environmental stability. On the other hand, when the content of the fine particles of titanium oxide is greater than 50% by weight, a sufficient image density fails to be secured.

Further, the primary particle size of titanium oxide preferably falls in a range of from 40 nm to 80 nm. This makes it possible to obtain a carrier which exhibits excellent resistance to toner contamination and makes a developer using the carrier exhibit excellent fluidity, even when being combined with a toner having a high blending quantity of wax. When the primary particle size of the titanium oxide is less than 40 nm, the particles of the titanium oxide fails to sufficiently remove the toner adhered to the carrier, thereby deteriorating the carrier resistance to toner contamination. When the primary particle size is greater than 80 nm, the irregularity of the coating surface of the carrier is increased, and thus it is impossible to obtain sufficient fluidity.

(Carbon Black)

The coating resin layer may be constituted by containing carbon black. The addition of carbon black enables the increase of electrification amount to be suppressed and a stable image density to be maintained. The additive amount of carbon black preferably falls in a range of from 1% by weight to 20% by weight relative to the weight of the core material.

(Core Material)

No particular limitation is imposed to the selection of the core material and a publicly known article can be used. For example, iron powder and ferrite can be used. Examples of the iron powder include reduced iron powder, atomized iron powder, iron nitride powder. The reduced iron powder and the iron nitride powder are amorphous, and therefore a conglobation treatment may be performed thereto. The ferrite can be ferrite powder, and examples of the ferrite powder include powder of copper, nickel, zinc, cobalt, manganese, and calcium. A ferrite carrier which is spherical, excellent in fluidity, and is also chemically stable, is preferably used for realizing a high quality and a long service life.

The core material may be either an amorphous shape or a spherical shape. In addition, the average particle size of the core material can be from 10 μm to 1000 μm, further preferably from 30 μm to 100 μm. When the average particle size of the core material is less than 30 μm, it follows that the carrier flows out by being adhered to the photoreceptor, namely carrier flying, thereby leading to a gradual reduction in the amount of a developer. In this case, it is more likely to fail to control appropriately the toner concentration in the two-component developer. Further, when the carrier flying comes to be serious, the developer appears on a recording material. In addition, when the average particle size of the core material is greater than 100 μm, an ear (magnetic brush) of the two-component developer occurs in a coarse manner at the time of transferring the toner in a two-component developer from a developing roller (a developing sleeve) to a photoreceptor. This makes it difficult to provide stable image quality, and it is likely to induce such a phenomenon that the two-component developer spills out from the developing vessel.

[Toner]

The toner constituting the two-component developer of the invention is constituted by adding an external additive to toner matrix particles which contain a binder resin, a coloring agent, a release agent, and a charge control agent.

Next, descriptions will be given to the constituents of the toner.

(Binder Resin)

The toner matrix particles are constituted by containing the binder resin. No particular limitation is imposed to the selection of the binder resin and a publicly known resin can be used. Examples of the binder resin include polystyrene, a styrene-acrylic copolymer, a styrene-acrylonitrile copolymer, a styrene-maleic anhydride copolymer, a styrene-acrylic-maleic anhydride copolymer, a polyvinyl chloride, a polyolefin resin, an epoxy resin, a silicone resin, a polyamide resin, a polyurethane resin, a urethane-modified polyester resin and an acrylic resin. The copolymers may be a block copolymer or a graft copolymer. In addition, one of the above resins may be used alone or two or more of them may be used in a combination. No particular limitation is imposed to the molecular weight distribution of the resins, but the resin having only one peak in molecular weight distribution is preferable.

Further, as for the thermal property of the binder resin, it is preferable that a glass transition temperature (Tg) of the binder resin is from 40° C. to 70° C. When the glass transition temperature thereof is lower than 40° C., the toner is melted and toners agglomerate with each other undesirably in a case where a temperature is increased in the image forming apparatus. In addition, when the glass transition temperature thereof is higher than 70° C., the binder resin is inferior in fixing property and short of practical utility.

(Coloring Agent)

The toner matrix particles are constituted by containing the coloring agent. No particular limitation is imposed to the selection of the coloring agent and a publicly known article can be used. Examples of the coloring agent include carbon black, iron black, an alloy azo dye, an oil-soluble dye, and a pigment. The coloring agent is preferably in an amount of from 1 part by weight to 10 parts by weight on the basis of the 100 parts by weight of the binder resin. When the amount of the coloring agent is less than 1 part by weight, a sufficient image density fails to be secured. On the other hand, when the amount of the coloring agent is more than 10 parts by weight, the coloring agent cannot be dispersed uniformly in the resin, thereby resulting in a failure to obtain a high-quality image.

(Release Agent)

The toner matrix particles are constituted by containing a wax which is used as a release agent and an anti-offset agent. No particular limitation is imposed to the selection of the wax and a publicly known article can be used. For example, a wax can be used which is composed of at least one type selected from a group consisting of polyethylene, polypropylene, an ethylene-propylene copolymer, and a polyolefin. The wax is preferably in an amount of from 1 part by weight to 10 parts by weight on the basis of the 100 parts by weight of the binder resin. When the amount of the wax is less than 1 part by weight, an offset phenomenon tends to be generated. On the other hand, when the amount of the wax is greater than 10 parts by weight, filming tends to be generated.

(Charge Control Agent)

The toner matrix particles are constituted by containing the charge control agent. The charge control agent includes two types of charge control agent, namely a charge control agent for positive charge control and a charge control agent for negative charge control. Examples of the charge control agent include an azo type dye, a metal complex of a carboxylic acid, a quaternary ammonium compound, and a nigrosine type dye. The charge control agent is preferably in an amount of from 0.1 part by weight to 5 parts by weight on the basis of 100 parts by weight of the binder resin. When the amount of the charge control agent is less than 0.1 part by weight, a sufficient chargeability fails to be imparted. On the other hand, when the amount is more than 5 parts by weight, the charge control agent fails to be uniformly mixed into the binder resin.

(External Additive)

The toner is constituted by adding the external additive to the toner matrix particles. No particular limitation is imposed to the selection of the external additive and a publicly known article can be used. Examples of the external additive include fine particles, namely, fine particles of metallic oxides such as silica, titanium oxide, alumina, magnetite and ferrite, and fine particles of metallic nitrides such as silicon nitride and boron nitride. Further, surfaces of the fine particles have preferably been subjected to a hydrophobic treatment. Examples of the hydrophobic treatment include a treatment by a silane coupling agent such as dimethyl dichlorosilane or an amylosilane, a treatment by a silicone oil and a treatment by a fluorine-containing component or the like component. One of the above external additives may be used alone or two or more of them may be used in combination. Further, as the external additive, silica is more preferable. Even when any fine particles other than silica particles are externally added solely, a sufficient charge may fail to be imparted in the contact of the toner and the carrier. Further, silica also acts as a fluidizing agent, so that it is possible to stabilize an amount of the toner to be supplied.

The external additive is preferably in an amount of from 0.1 part by weight to 5.0 parts by weight on the basis of the 100 parts by weight of the toner matrix particles.

(Toner Production Method)

Next, the toner production method will be explained.

The toner can be produced using conventionally known methods.

For example, the toner can be produced by the following process: sufficiently mixing the binder resin, the coloring agent, the release agent, the charge control agent and the like by using a mixer such as a Henschel mixer and a super mixer; melt-kneading the resultant mixture by using a twin-screw kneader; pulverizing the thus-kneaded article by using a jet pulverizer and classifying thereafter the thus-pulverized article to thereby obtain toner matrix particles having a volume average particle size of approximately 5 μm to 15 μm; and further, adding inorganic fine particles or the like as the external additive to the toner matrix particles; and finally causing the inorganic fine particles to be uniformly adhered thereto and to be uniformly dispersed by using a mixer such as the Henschel mixer and the super mixer.

[Two-Component Developer]

The two-component developer according to the invention can be produced by mixing the toner and the carrier by means of the mixer such that a specified toner concentration is derived therefrom. As the mixer, a publicly known mixer can be used. For example, a Nauta mixer and a V-type mixer can be mentioned.

The two-component developer in the invention contains the carrier excellent in durability and environmental stability of the invention. This leads to that the two-component developer enables stable chargeability to be obtained even after having been used in a high-temperature and high-humidity environment for a long period of time in a downsized image forming apparatus capable of performing high-speed operations. Consequently, the two-component developer enables a high-quality image to be obtained.

Next, the invention is described concretely with reference to Examples and Comparative Examples. However, the invention is not limited thereto unless departing from the purport of the invention.

Example A

In Example A, a study was made on an influence of a carrier coating amount of a carrier constituting a two-component developer, namely a weight percentage of a coating resin layer relative to the weight of a core material.

Example 1

Production Example of Toner

Firstly, a toner was produced according to a process as described below. 7.5 parts by weight of carbon black (trade name: 330R; manufactured by Cabot Corporation) as a coloring agent, 2.0 parts by weight of polyethylene (trade name: PE130; manufactured by Clariant (Japan) K.K.) as a wax, and 1.0 part by weight of a charge control agent (trade name: S-34; manufactured by Hodogaya Chemical Co., Ltd.) were added on the basis of the 100 parts by weight of a binder resin followed by being fully mixed into a super mixer (trade name: V-20; manufactured by KAWATA MFG. CO., LTD). And then, the resultant mixture was melt-kneaded by using a twin-screw kneader (trade name: PCM-30; manufactured by Ikegai Corporation). The resultant kneaded article was pulverized by using a jet pulverizer (trade name: IDS-2; manufactured by Nippon Pneumatic Mfg., Co., Ltd.) and classified, to thereby obtain toner matrix particles having a volume average particle size of 7.0 μm. Thereafter, 1.2 parts by weight of silica fine particles (trade name: R972; manufactured by Nippon Aerosil Co., Ltd.) as an external additive were externally added on the basis of the 100 parts by weight of the thus-obtained 1 toner matrix particles, to thereby prepare the toner.

Production Example of Carrier

Firstly, after a content rate of anatase-type crystal and rutile-type crystal in fine particles of titanium oxide, a hydrophobic treatment was performed, to thereby prepare the fine particles of titanium oxide.

The content rate of the respective crystals in the fine particles of titanium oxide was adjusted as described below. A volatile titanium tetrachloride was formed to gaseous at high temperature and was thermally hydrolyzed at A ° C. in the presence of oxygen gas and hydrogen gas. In this case, the titanium concentration in the raw gas containing oxygen gas, hydrogen gas, and gaseous titanium tetrachloride was B ($g/cm^3$) in titanium dioxide concentration equivalent. The content rate of the respective crystals in the fine particles of titanium oxide was adjusted by appropriately changing values of A and B.

The hydrophobic treatment was performed as mentioned below. 100 parts by weight of the fine particles were put into a mixer, in which the content rate of the respective crystals had been adjusted. 20 parts by weight of i-butyltrimethoxysilane dripped thereto while being stirred in nitrogen atmosphere at room temperature. After that, the thus-obtained mixture was heated for 2 hours at 150° C. followed by being cooled down.

Note that identification of the respective crystals in the fine particles of titanium oxide was carried out as mentioned below. The obtained fine particles of titanium oxide were put into a sample holder and were pressed into a planar shape on a glass plate so as to prepare a sample to be measured. The thus-prepared sample to be measured was subjected to a crystal identification using an X-ray diffractometer (manufactured by Philips Corporation). Based on a diffraction intensity Ia which was the strongest interference ray of the anatase-type crystal and a diffraction intensity Ir which was the strongest interference ray of the rutile-type crystal, a content rate A of the anatase-type crystal and a content rate B of the rutile-type crystal were determined using equations (1) and (2) as shown in the following:

$$A(\%)=100/(1+1.265\times Ir/Ia) \quad (1)$$

$$B(\%)=100-A \quad (2)$$

Next, a carrier was produced as described below.

A silicone resin (trade name: KR-255; manufactured by Shin-Etsu Chemical Co., Ltd.) was used as a coating resin. As fine particles of titanium oxide used for producing the carrier, fine particles of titanium oxide were employed, of which primary particle size was 60 nm and in which the content rate of the rutile-type crystal was 10% on the basis of the total amount of crystal. The silicone resin, the fine particles of titanium oxide, and carbon black (trade name: KETJENBLACK EC; manufactured by Lion Corporation) were added into toluene and thereafter were dispersed therein such that the silicone resin came to be 2% by weight, the fine particles of titanium oxide came to be 10% by weight, and the carbon black came to be 5.0% by weight, relative to the weight of the core material. The thus-obtained dispersion solution was applied according to the dipping method onto a ferrite core material having an average particle size of 60 μm using a fluid bed type coating apparatus. The resin thus-applied to the ferrite core material was cured by being heated for 2 hours at 250° C., to thereby obtain the carrier.

The toner obtained in such manner as described above and a ferrite carrier which has been coated with the coating resin layer such that a carrier coating amount came to be 6.0% by weight were mixed for 20 minutes by using a Nauta mixer (trade name: VL-0; manufactured by Hosokawa Micron Corporation) such that the toner concentration came to be 5.0% by weight, to thereby produce a two-component developer.

Example 2

A two-component developer was produced in the same manner as in Example 1 except that the carrier coating amount was set to be 5.0% by weight.

Example 3

A two-component developer was produced in a same manner as in Example 1 except that the carrier coating amount was set to be 15.0% by weight.

Example 4

A two-component developer was produced in the same manner as in Example 1 except that the carrier coating amount was set to be 20.0% by weight.

Comparative Example 1

A two-component developer was produced in the same manner as in Example 1 except that the carrier coating amount was set to be 4.0% by weight.

Comparative Example 2

A two-component developer was produced in the same manner as in Example 1 except that the carrier coating amount was set to be 3.0% by weight.

Comparative Example 3

A two-component developer was produced in the same manner as in Example 1 except that the carrier coating amount was set to be 25.0% by weight.

[Evaluation Method]

The two-component developers of Examples 1 and 2 and Comparative Examples 1 and 2 were evaluated in terms of changes in image density in such manner as described below and the results are shown in Table 1. The two-component developers of Examples 3 and 4 and Comparative Example 3 were evaluated in terms of environmental stabilities in such manner as described below and the results are shown in Table 2. Note that evaluations "Excellent", "Good", and "Poor" described in explanations of evaluation items represent evaluation results shown in Tables 1 and 2. The evaluation "Excellent" represents being excellent, the evaluation "Good" represents being good, and the evaluation "Poor" represents being difficult for practical use.

(Changes in Image Density)

By using the two-component developers of Examples 1 and 2 and Comparative Examples 1 and 2, an original document having a print ratio of 5% was printed by using a monochrome copying machine (trade name: AR-455; manufactured by Sharp Corporation).

An image density of an image printed out by using a developer of an initial stage (an initial image density) and another image density of the image after 100,000 copies of the original document having a print ratio of 5% were printed with an interval every 5 sheets (image density after 100,000 sheets were printed) were measured by using a Macbeth reflection densitometer (trade name: RD-914; manufactured by Macbeth Co., Ltd.). Evaluations on changes in image density were performed in accordance with the following criteria on the basis of the image density after 100,000 sheets were printed.

Good: An image density is 1.30 or higher.

Poor: An image density is less than 1.30.

TABLE 1

| | Carrier | Change in image density | | |
|---|---|---|---|---|
| | coating amount (% by weight) | Initial | After printing 100,000 sheets | Evaluation |
| Example 1 | 6.0 | 1.36 | 1.34 | Good |
| Example 2 | 5.0 | 1.37 | 1.31 | Good |
| Comparative Example 1 | 4.0 | 1.35 | 1.16 | Poor |
| Comparative Example 2 | 3.0 | 1.37 | 1.09 | Poor |

As seen from Table 1, in using the two-component developers of Examples 1 and 2 using the carrier in which the carrier coating amount was 5.0% by weight or more relative to the weight of the core material, the image densities after 100,000 sheets were printed were substantially the same as the initial image densities. Consequently, the two-component developers of Examples 1 and 2 each were a developer excellent in durability capable of maintaining the image density even after 100,000 sheets were printed. On the other hand, in using the two-component developers of Comparative Examples 1 and 2 using the carrier in which the carrier coating amount was less than 5.0% by weight relative to the weight of the core material, the image densities were decreased sharply after 100,000 sheets were printed, compared with the initial image densities. Consequently, the two-component developers of Comparative Examples 1 and 2 each were a developer difficult for practical use due to low durability.

(Environmental Stability)

After the two-component developers of Examples 3 and 4 and Comparative Example 3 were set in the monochrome copying machine (trade name: AR-455; manufactured by Sharp Corporation) and were left thereafter to stand for 17 hours in a high-temperature (35° C.) and high-humidity (relative humidity: 85%) environment, an original document having a print ratio of 5% was printed. Background fogging of the printed image was measured by using a Hunter whiteness meter (Nippon Denshoku Industries., Co., Ltd.), and then the thus-measured results were evaluated in accordance with the following criteria.

Excellent: a value of background fogging is less than 0.5.

Good: a value of background fogging is 0.5 or more and less than 1.0.

Poor: a value of background fogging is 1.0 or more.

TABLE 2

| | Carrier | Environmental stability | |
|---|---|---|---|
| | coating amount (% by weight) | Background fogging | Evaluation |
| Example 3 | 15.0 | 0.44 | Excellent |
| Example 4 | 20.0 | 0.75 | Good |
| Comparative Example 3 | 25.0 | 1.32 | Poor |

As seen from the results shown in Table 2, the two-component developers of Examples 3 and 4 using the carrier in which the carrier coating amount was 20% by weight or less, were developers excellent in environmental stability having a background fogging value of less than 1.0, even when the carrier coating amount was 5% by weight or more. On the other hand, the two-component developer of Comparative Example 3 using the carrier in which the carrier coating amount was greater than 20% by weight was a developer which had a background fogging value of 1.0 or more and was difficult for practical use due to its inferior environmental stability.

Example B

In Example B, a study was made on an influence of a content rate of rutile-type crystal in the total amount of crystal of titanium oxide fine particles.

Example 5

Production Example of Toner

A toner was produced using basically the same manner as in Example 1, except that 4.3 parts by weight of polyethylene (trade name: PE130; manufactured by Clariant (Japan) K.K.) was added as a wax and that changes were made to kneading conditions such as kneading temperature for kneading a resultant mixture using a twin-screw kneader (trade name: PCM-30; manufactured by Ikegai Corporation) and pulverizing conditions such as air pressure for pulverizing the resultant kneaded article by using a jet pulverizer (trade name: IDS-2; manufactured by Nippon Pneumatic Mfg., Co., Ltd.).

Production Example of Carrier

A carrier was produced using basically the same manner as in Example 1 except that fine particles of titanium oxide of which primary particle size was 50 nm and in which the content of rutile-type crystal was in an amount of 5% on the basis of the total amount of crystal, were added in an amount of 10% by weight relative to the weight of a core material.

A two-component developer was produced in the same manner as in Example 1 by using the toner obtained in such manner as described above and a ferrite carrier which was coated with the coating resin such that a carrier coating amount came to be 6.0% by weight.

Example 6

A two-component developer was produced in basically the same manner as in Example 5 except that a content rate of rutile-type crystal was set to be 10%.

Example 7

A two-component developer was produced in basically the same manner as in Example 5 except that a content rate of rutile-type crystal was set to be 20%.

Example 8

A two-component developer was produced in basically the same manner as in Example 5 except that a content rate of rutile-type crystal was set to be 3%.

Example 9

A two-component developer was produced in basically the same manner as in Example 5 except that a content rate of rutile-type crystal was set to be 25%.

Comparative Example 4

A two-component developer was produced in basically the same manner as in Example 5 except that a content rate of rutile-type crystal was set to be 0%.

[Evaluation Method]

The two-component developers of Examples 5-9 and Comparative Example 4 were evaluated as described below in terms of changes in image density, environmental stability, resistance to toner-contamination, and fluidity. The results are shown in Table 3. Note that evaluations "Excellent", "Good", "Available", and "Poor" described in explanation of evaluation items represent evaluation results shown in Table 3. The evaluation "Excellent" represents being excellent, the evaluation "Good" represents being good, the evaluation "Available" represents being possible to be put into practical use, and the evaluation "Poor" represents being difficult for practical use.

(Changes of Image Density in a High-Temperature and High-Humidity Environment)

In a high-temperature (35° C.) and high-humidity (relative humidity: 85%) environment, an initial image density and another image density after 100,000 sheets had been printed were measured according to the same method as used in Example A. On the basis of the image density which was measured after 100,000 sheets had been printed, changes in image density in a high-temperature and high-humidity environment were evaluated in accordance with the following criteria.

Good: an image density is 1.30 or higher.

Available: an image density is less than 1.30.

(Environmental Stability)

Background fogging was measured according to the same method as used in Example A. In addition, a toner replenishment time was measured after the two-component developers had been left to stand for 17 hours. Note that the term "toner replenishment time" as used herein means a time duration of from the time at which the two-component developer starts to be stirred to the time at which the toner of the two-component developer adheres to the photoreceptor, namely, the supply time of the toner. The toner replenishment time varies with changes in the fluidity and chargeability of the two-component developer resulted from having been left to stand for a long period of time in a high-temperature and high-humidity environment. On the basis of the measured values of background fogging and the measured toner replenishment time, evaluations on the environmental stability were performed in accordance with the following criteria.

Excellent: a value of background fogging is less than 0.5.

Good: a value of background fogging is 0.5 or more and less than 1.0.

Available: a value of background fogging is 1.0 or more, and the toner replenishment time is 25 seconds or less.

Poor: a value of background fogging is 1.0 or more, and the toner replenishment time is greater than 25 seconds.

(Resistance to Toner Contamination)

Resistance to toner contamination was evaluated on the two-component developers which had been used to evaluate the image densities after 100,000 sheets were printed in a high-temperature (35° C.) and high-humidity (relative humidity: 85%) environment. The evaluation was performed in a manner as described blow. The two-component developers were put on a 635-mesh test sieve (opening dimension: 20 μm), and then the toner and the carrier were separated by the suction of toner from below of the 635-mesh test sieve by means of a toner cleaner, followed by addition of 1 g of the thus-obtained carrier into 10 ml of tetrahydrofuran which was then stirred. The absorbance of the tetrahydrofuran was thereafter measured using a spectrophotometer (trade name: U-1800; manufactured by Hitachi Co., Ltd.). Take a black toner in the present Example as an example to explain how to evaluate resistance to toner contamination. The absorbance was measured at 600 nm which is the absorption wavelength of the black toner. The thus-measured absorbance value was converted into a contamination degree (% by weight) relative to the weight of carrier, on the basis of a pre-made calibration curve representing a relationship between concentration (mg/ml) and absorbance of tetrahydrofuran solution. And then, the resistance to toner contamination was evaluated in accordance with the following criteria.

Excellent: a contamination degree per unit weight is less than 0.05.

Good: a contamination degree per unit weight is 0.05 or more and less than 0.15.

Available: a contamination degree per unit weight is 0.15 or more and less than 0.45.

Poor: a contamination degree per unit weight is 0.45 or more.

(Fluidity)

After the two-component developers had been left to stand for 17 hours in a high-temperature (35° C.) and high-humidity (relative humidity: 85%) environment, apparent densities were measured using a powder tester (manufactured by Hosokawa Micron Corporation). The measurement was performed in a manner as described below. A 60-mesh sieve was set on a shaking table, and a cup for measuring apparent density of which weight had been measured in advance was set immediately therebelow. Next, a rheostat scale was set at a value of 2.0, the shaking table started to be shaken, and a measurement sample was caused to run through the 60-mesh sieve from above while being shaken and thereafter enter the cup for measuring apparent density. After the cup for measuring apparent density overflowed owing to the filling of the sample, the shake was stopped. And then the sample located exceeding the height of the cup for measuring apparent density was removed by using a blade, followed by measuring accurately the weight of the cup using a weighing machine. The volume of the cup for measuring the apparent density was 100 $cm^3$, and the apparent density ($g/cm^3$) could be determined correspondingly. Evaluations on fluidity were performed in accordance with the following criteria.

Excellent: an apparent density is 1.95 $g/cm^3$ or higher.

Good: an apparent density is 1.85 $g/cm^3$ or higher and less than 1.95 $g/cm^3$.

Available: an apparent density is 1.70 $g/cm^3$ or higher and less than 1.85 $g/cm^3$.

Poor: an apparent density is less than 1.70 $g/cm^3$.

TABLE 3

| | Content rate of rutile crystal (%) | Change of image density in a high-temperature and high-humidity environment: After printing: Initial | 100,000 sheets | Evaluation | Environmental stability: Replenishment time (s) | Background fogging | Evaluation | Resistance to toner contamination: Absorbance | Evaluation | Fluidity: Apparent density ($g/cm^3$) | Evaluation | Comprehensive evaluaiton |
|---|---|---|---|---|---|---|---|---|---|---|---|---|
| Example 5 | 5 | 1.36 | 1.34 | Good | 6 | 0.74 | Good | 0.12 | Good | 1.88 | Good | Good |
| Example 6 | 10 | 1.35 | 1.31 | Good | 8 | 0.42 | Excellent | 0.04 | Excellent | 1.98 | Excellent | Excellent |
| Example 7 | 20 | 1.38 | 1.33 | Good | 15 | 0.68 | Good | 0.03 | EXcellent | 1.85 | Good | Good |
| Example 8 | 3 | 1.37 | 1.07 | Available | 25 | 1.06 | Available | 0.25 | Available | 1.72 | Available | Available |
| Example 9 | 25 | 1.36 | 1.25 | Available | 18 | 0.79 | Good | 0.02 | Excellent | 1.76 | Available | Available |
| Comparative Example 4 | 0 | 1.38 | 1.11 | Available | 32 | 1.23 | Poor | 0.38 | Available | 1.68 | Poor | Poor |

As seen from the results shown in Table 3, even when the carrier coating amount was 5% by weight or more, excellent results were obtained when the changes of image density and environmental stability in a high-temperature and high-humidity environment were evaluated on the two-component developers using the carrier of Examples 5-7 in which the content rate of rutile-type crystal was from 5% to 20%. Moreover, even when a toner was used in which the blending amount of wax was as high as 4.3 parts by weight, excellent results were obtained when the resistance to toner contamination and fluidity were evaluated. Consequently, the two-component developers of Examples 5-7 were developers excellent in comprehensive practical utility.

On the other hand, inferior results were obtained when environmental stability and fluidity were evaluated on the two-component developer of Comparative Example 4 using the carrier in which the content rate of rutile-type crystal was 0%. Consequently, the two-component developer of Comparative Example 4 was a developer difficult for practical utility. Slightly inferior results were obtained when all the evaluation items were performed on the two-component developer of Example 8 using the carrier in which the content rate of rutile-type crystal was 3%. However, the two-component developer of Example 8 was a developer possible to be put into practical use. In addition, slightly inferior results were obtained when changes in image density and fluidity in a high-temperature and high-humidity environment were evaluated on the two-component developer of Example 9 using the carrier in which the content rate of rutile-type crystal was 25%. However, the two-component developer of Example 9 was a developer possible to be put into practical use.

Example C

In Example C, a study was made on an influence of a content of titanium oxide fine particles in coating resin.

Example 10

Production Example of Toner

A toner was produced in the same manner as in Example 5.

Production Example of Carrier

A carrier was produced in basically the same manner as in Example 1 except that titanium oxide fine particles of which primary particle sizes were 50 nm and in which a content rate of rutile-type crystal was 10% on the basis of the total amount of crystal, were added in an amount of 5% by weight relative to the weight of the core material.

A two-component developer was produced in the same manner as in Example 1 by using the toner obtained in such manner as described above and a ferrite carrier which was coated with the coating resin such that a carrier coating amount came to be 6.0% by weight.

Example 11

A two-component developer was produced in basically the same manner as in Example 10 except that the fine particles of titanium oxide were added in an amount of 25% by weight relative to the weight of the core material.

Example 12

A two-component developer was produced in basically the same manner as in Example 10 except that the fine particles of titanium oxide were added in an amount of 50% by weight relative to the weight of the core material.

Example 13

A two-component developer was produced in basically the same manner as in Example 10 except that the fine particles of titanium oxide were added in an amount of 1% by weight relative to the weight of the core material.

Example 14

A two-component developer was produced in basically the same manner as in Example 10 except that the fine particles of titanium oxide were added in an amount of 60% by weight relative to the weight of the core material.

[Evaluation Method]

The two-component developers of Examples 10-14 were evaluated as described below in terms of image densities and environmental stability in a high-temperature and high-humidity environment. The results are shown in Table 4. Note that evaluations "Excellent", "Good", and "Available" described in explanation of evaluation items represent evaluation results shown in Table 4. The evaluation "Excellent" represents being excellent, the evaluation "Good" represents being good, and the evaluation "Available" represents being possible to be put into practical use.

(Image Density)

Image densities in the initial stage were measured according to the same method as used in Example A, and the thus-measured image densities were evaluated in accordance with the following criteria.

Good: an image density of the initial stage is 1.30 or higher.

Available: an image density of the initial stage is less than 1.30.

(Environmental Stability)

The evaluations on environmental stability were performed according to the same method as used in Example B.

TABLE 4

| | Content amount of titanium oxide fine particles | Image density | | Environmental stability | | | |
|---|---|---|---|---|---|---|---|
| | | | | Replenishment time | Background | | Comprehensive |
| | (% by weight) | Initial | Evaluation | (s) | fogging | Evaluation | evaluation |
| Example 10 | 5 | 1.37 | Good | 7 | 0.43 | Excellent | Excellent |
| Example 11 | 25 | 1.36 | Good | 4 | 0.21 | Excellent | Excellent |
| Example 12 | 50 | 1.35 | Good | 4 | 0.20 | Excellent | Excellent |
| Example 13 | 1 | 1.38 | Good | 15 | 1.07 | Available | Available |
| Example 14 | 60 | 1.26 | Available | 3 | 0.25 | Excellent | Available |

As seen from Table 4, excellent results were obtained when image density and environmental stability were evaluated on the two-component developers using the carrier of Examples 10-12 in which the content of titanium oxide fine particles was from 5% by weight to 50% by weight. Consequently, the two-component developers of Examples 10-12 were developers excellent in comprehensive practical utility.

On the other hand, slightly inferior results were obtained when environmental stability was evaluated on the two-component developer of Example 13 using the carrier in which the content of titanium oxide fine particles was 1% by weight. However, the two-component developer of Example 13 was a developer possible to be put into practical use. In addition, slightly inferior results were obtained when image density was evaluated on the two-component developer of Example 14 using the carrier in which the content of titanium oxide fine particles was 60% by weight. However, the two-component developer of Example 14 was a developer possible to be put into practical use.

Example D

In Example D, a study was made on an influence of primary particle size of titanium oxide fine particles.

Example 15

Production Example of Toner

A toner was produced in the same manner as in Example 5.

Production Example of Carrier

A carrier was produced in basically the same manner as in Example 1 except that fine particles of titanium oxide of which primary particle size was 40 nm and in which a content rate of rutile-type crystal was 10% on the basis of the total amount of crystal, were added in an amount of 20% by weight relative to the weight of the core material.

A two-component developer was produced in the same manner as in Example 1 by using the toner obtained in such manner as described above and a ferrite carrier which was coated with the coating resin such that a carrier coating amount came to be 6.0% by weight.

Example 16

A two-component developer was produced in basically the same manner as in Example 15 except that the primary particle size of titanium oxide fine particles was set to be 60 nm.

Example 17

A two-component developer was produced in basically the same manner as in Example 15 except that the primary particle size of titanium oxide fine particles was set to be 80 nm.

Example 18

A two-component developer was produced in basically the same manner as in Example 15 except that the primary particle size of titanium oxide fine particles was set to be 20 nm.

Example 19

A two-component developer was produced in basically the same manner as in Example 15 except that the particle size of titanium oxide fine particles was set to be 100 nm.

[Evaluation Method]

The two-component developers of Examples 15-19 were evaluated as described below in terms of resistance to toner contamination and fluidity. The results are shown in Table 5. Note that evaluations "Excellent", "Good", and "Available" described in explanation of evaluation items represent evaluation results shown in Table 5. The evaluation "Excellent" represents being excellent, the evaluation "Good" represents being good, and the evaluation "Available" represents being possible to be put into practical use.

(Resistance to Toner Contamination)

Evaluations on resistance to toner contamination were performed according to the same method and evaluation criteria as used in Example B.

(Fluidity)

Evaluations on fluidity were performed according to the same method and evaluation criteria as used in Example B.

TABLE 5

| | Particle size of titanium oxide fine particles (nm) | Resistance to toner contamination | Evaluation | Fluidity (g/cm3) | Evaluation | Comprehensive evaluation |
|---|---|---|---|---|---|---|
| Example 15 | 40 | 0.15 | Good | 1.99 | Excellent | Excellent |
| Example 16 | 60 | 0.07 | Good | 1.91 | Good | Good |
| Example 17 | 80 | 0.05 | Excellent | 1.87 | Good | Excellent |
| Example 18 | 20 | 0.41 | Available | 2.03 | Excellent | Available |
| Example 19 | 100 | 0.04 | Excellent | 1.73 | Available | Available |

As seen from the results shown in Table 5, excellent results were obtained when resistance to toner contamination and fluidity were evaluated on the two-component developers using the carrier of Examples 15-17 in which the primary particle size of the titanium oxide fine particles was from 40 nm to 80 nm, even in the case of using a toner which had a blending amount of wax was as high as 4.3 parts by weight. Consequently, the two-component developers of Examples 15-17 were developers excellent in comprehensive practical utility.

On the other hand, slightly inferior results were obtained, when the resistance to toner contamination was evaluated on the two-component developer using the carrier of Example 18 in which the primary particle size of titanium oxide fine particles was 20 nm. However, the two-component developer of Example 18 was a developer possible to be put into practical use. In addition, slightly inferior results were obtained, when fluidity was evaluated on the two-component developer using the carrier of Example 19 in which the primary particle size of titanium oxide fine particles was 100 nm. However, the two-component developer of Example 19 was a two-component developer possible to be put into practical use.

As has been described heretofore, the two-component developers using the carriers of Examples 1-19 of the invention are excellent in durability and environmental stability by causing a coating resin layer for coating a core material to contain fine particles of titanium oxide having a anatase-type crystal structure and a rutile-type crystal structure and further by determining a carrier coating amount of the coating resin layer to be from 5% by weight to 20% by weight.

It is preferable that the content rate of rutile-type crystal in the fine particles of titanium oxide falls in a range of from 5% to 20% on the basis of the total amount of crystal. In addition, it is preferable that the primary particle size of the titanium oxide fine particles falls in a range of from 40 nm to 80 nm. In this way, a two-component developer excellent in resistance to toner contamination and in fluidity can be obtained.

In addition, a two-component developer excellent in durability and environmental stability can be obtained by determining the content of titanium oxide fine particles to be from 5% by weight to 50% by weight relative to the weight of the core material.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A carrier for a two-component developer, comprising a core material; and a coating resin layer with which the core material is coated, the coating resin layer being in an amount of from 5% by weight to 20% by weight relative to a weight of the core material, and the coating resin layer containing fine particles of titanium oxide having an anatase-type crystal structure and a rutile-type crystal structure, wherein a content rate of the rutile-type crystal falls in a range of from 5% to 20% on the basis of the total amount of crystal.

2. The carrier of claim 1, wherein the fine particles of titanium oxide are contained in an amount of from 5% by weight to 50% by weight relative to the weight of the core material.

3. The carrier of claim 1, wherein a primary particle size of the fine particles of titanium oxide falls in a range of from 40 nm to 80 nm.

4. A two-component developer comprising a toner; and the carrier of claim 1.

* * * * *